United States Patent [19]

Thurn

[11] 4,422,625

[45] Dec. 27, 1983

[54] FOUNDRY POURING LADLE PROTECTIVE LINER

[75] Inventor: Carrol R. Thurn, Minnetonka, Minn.

[73] Assignee: FMC Corporation, Chicago, Ill.

[21] Appl. No.: 351,557

[22] Filed: Feb. 23, 1982

[51] Int. Cl.[3] ..... C21B 3/00

[52] U.S. Cl. ..... 266/281; 266/275

[58] Field of Search ..... 266/275, 280, 281; 164/165, 160.1, 235; 75/96

[56] References Cited

U.S. PATENT DOCUMENTS

| | | | |
|---|---|---|---|
| 3,203,689 | 8/1965 | Hallowell | 266/281 X |
| 3,689,051 | 9/1972 | Miller | 266/275 |
| 4,012,209 | 3/1977 | Seguin et al. | 266/275 |
| 4,055,336 | 10/1977 | Massin | 266/275 X |

*Primary Examiner*—G. Ozaki

*Assistant Examiner*—David A. Hey

*Attorney, Agent, or Firm*—H. M. Stanley; R. B. Megley

[57] ABSTRACT

A steel ladle is provided with a burn resistant liner generally conforming to the inner contour of the ladel but spaced therefrom. A layer of sand is placed within the space between the ladle and liner to support the liner when loaded with a non-ferrous melt. The sand and the liner are retained within the ladle by a refractory cap extending between the upper edges of the liner and the ladle on top of the sand layer. A method of preparing a ladle to receive a non-ferrous melt involves lining the ladle interior with a burn resistant lining, supporting the lining on a sand layer disposed between the ladle interior and the lining, and retaining the sand and the liner within the ladle so they will not separate therefrom during pouring.

15 Claims, 6 Drawing Figures

FOUNDRY POURING LADLE PROTECTIVE LINER

BACKGROUND OF THE INVENTION

1. Field of the Invention

The present invention pertains to non-ferrous foundry arts, and more particularly a pouring ladle for transferring molten non-ferrous metal from a melting furnace to a casting mold.

2. Description of the Prior Art

FIG. 1 shows a pouring ladle 10, usually constructed of steel, in cross section having a refractory lining in the range of one to two inches thick applied over the entire internal surface of the ladle. The refractory lining may be of any appropriate material such as zircon refractory material which is well known in this art. The combination of the ladle and refractory lining shown in FIG. 1 is old art and is discussed here to show the current manner in which a steel pouring ladle is provided protection from a non-ferrous melt such as molten aluminum poured therein.

The ladle assembly of FIG. 1 requires a heavy preheat prior to pouring a non-ferrous melt therein. A steel ladle weighing about one thousand pounds is capable of transporting about one thousand pounds of aluminum in liquid phase and requires a preheat for about one hour using a flame supported by about fifteen hundred cubic feet of gas per hour. The preheat brings the interior of the ladle assembly of FIG. 1 up to the range of 500 to 700 degrees Fahrenheit and is undertaken for the purpose of driving off as much mechanically and chemically held moisture as possible from the lining prior to introducing the melt into the ladle. It is not possible to drive off all of the moisture from the refractory material 11 as there are compounds such as aluminum oxide, magnesium oxide and aluminum chloride among others which are formed in the presence of melted aluminum and which adhere to the refractory material once it is exposed to an aluminum melt. The aforementioned compounds are hygroscopic in nature and appear to hold molecular hydrogen and water chemically. The combinations which appear to be readily formed when melted aluminum is handled by usual foundry practices are collectively termed dross, which is equivalent to slag in the terminology associated with ferrous metal foundry practices, and which is scattered throughout the body of the aluminum melt. That dross which is left behind by a melt on the walls of the refractory material is extremely difficult to remove prior to pouring a subsequent melt in the ladle assembly of FIG. 1 and a higher concentration of dross is noticed in subsequent pourings. This results in increased outgassing from the refractory material as a skull or layer containing the undesirable compounds collects at the surface of the ladle. The result is observed in what are termed gassy castings of comparatively low quality. The skull is readily formed on the refractory material surfaces with each melt poured into the ladle because the refractory material is easily wetted by the melt.

SUMMARY OF THE INVENTION

The invention disclosed herein relates to a ladle assembly for receiving and transferring non-ferrous metal in a liquid state between a melting furnace and a casting mold. A rigid external ladle is fabricated of a material having a melting point above that of the liquid metal temperature. A ladle liner is inserted into the ladle. The liner is made of a material which burns at a temperature above the temperature of the molten metal contained therein. The liner has an external surface which is generally similar in shape to the internal surface of the ladle. A refractory cap is disposed along the upper surfaces of the ladle liner and the ladle respectively.

In another aspect of the invention a method is disclosed for fabricating a liner for a ladle which is adapted to hold molten non-ferrous metal. A liner forming tool is used in performing the method. The forming tool has an interior chamber enclosed by a perforate wall having an exterior shape which is slightly smaller than but substantially similar to the shape of the ladle inner contour. The method comprises the steps of combining burn resistant fibers and a fiber binder in about ten to one proportions by weight with water. The combination is agitated to form an aqueous slurry. A portion of the slurry is thereafter transferred to a forming tank and the liner forming tool is submerged in the slurry within the forming tank. The pressure is reduced below atmospheric pressure within the enclosed interior chamber of the tool. The time during which the pressure is reduced within the forming tool is monitored whereby a predetermined time corresponds to formation of a predetermined liner wall thickness as the fibers and binders are moved by pressure differential to the outer surface of the tool. The tool is removed from the forming tank with the formed liner adhering thereto. The liner is then dried while adhering to the tool and the dried liner is thereafter stripped from the tool.

According to yet another aspect of the invention a method of protecting a molten metal pouring ladle from the effects of a non-ferrous melt which is being transferred from a melting furnance to a mold by the ladle comprises the steps of placing a burn resistant liner within the ladle wherein the liner contour is similar to the contour of the ladle interior wall. A refractory cap is laid in position overlying the upper edges of the ladle and the liner. A quantity of molten metal is poured from the furnace into the lined ladle. The loaded ladle is moved to a position overlying a casting mold. The molten metal is emptied from the lined ladle by pouring it into the mold. The skull is thereafter readily peeled from the interior of the empty ladle liner prior to pouring a subsequent quantity of molten metal therein.

DESCRIPTION OF THE PREFERRED EMBODIMENTS

Figure 1:
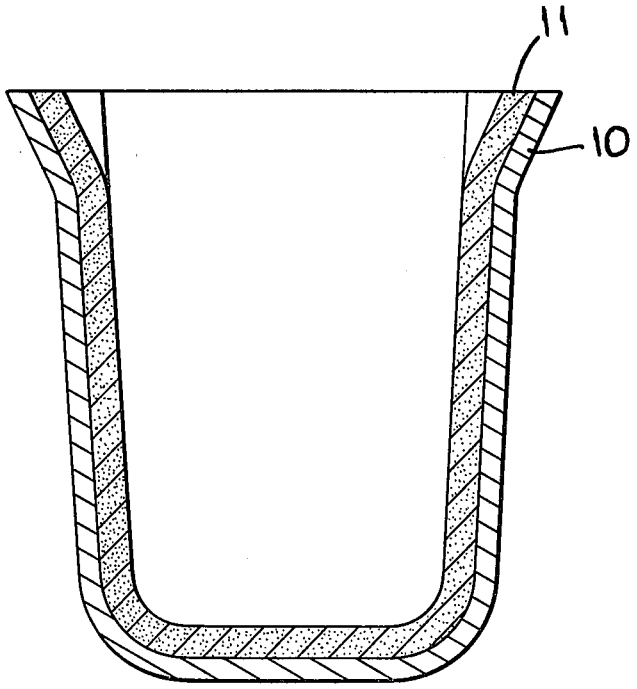
PRIOR ART FIG 1
FIG. 1 is a vertical section of an old art pouring ladle.

As shown in FIG. 1 and discussed in the background portion of this specification prior art molten metal pouring ladles include a steel external ladle shell 10 and a two to three inch thick protective layer of refractory material, such as zircon refractory, spread over the entire inner contour of the ladle and dried in place. A dross containing various oxides and other compounds as well as any included impurities is formed by a non-ferrous metal when in a molten state. The dross may be scattered throughout the melt and its presence results in imperfections in castings poured from the melt. The melt wets the refractory material readily and as a result the dross forms a skull containing the aforementioned oxides, other compounds and impurities on the inner surface of the refractory material. This skull is highly hygroscopic and captures hydrogen and water molecules chemically which are then driven off by the heat of a subsequently deposited melt to enter the melt and cause further imperfections in the castings poured therefrom. To avoid this problem the skull is laboriously chipped off of the inner surface of the refractory material 11 by hand labor. Even the most heroic efforts do not remove all of the dross and the problem thereby persists to some extent when a new melt is poured into a ladle with a supposedly cleaned up refractory lining.

The handling of non-ferrous melts is discussed hereinafter, wherein such melts include aluminum, copper and brass and bronze alloys. The examples and specific temperatures recited hereinafter will be specifically for molten aluminum, although the aforementioned other non-ferrous melts are capable of being handled by means of the inventive concepts disclosed herein.

Figure 2:
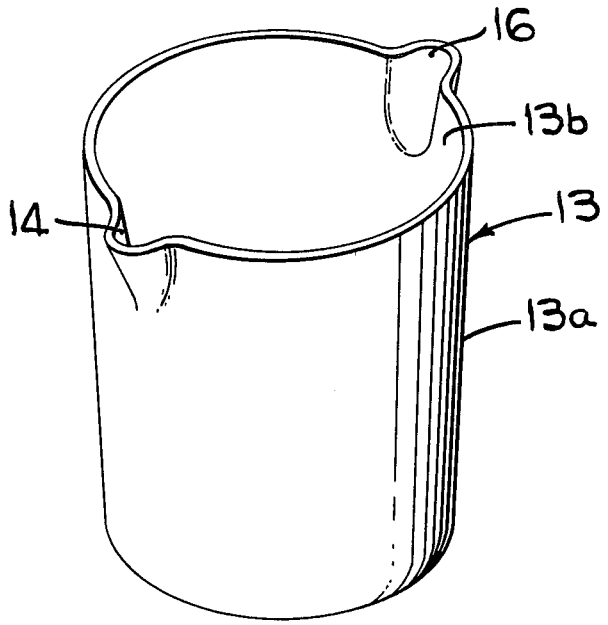
FIG. 2 is a perspective view of a ladle liner according to the present invention.

In FIG. 2 a ladle liner 13 is shown having an external surface 13*a* which is generally similar to the internal contours of an external ladle 10 as seen in FIG. 1. The external dimensions of the ladle liner 13 are slightly smaller than the internal dimensions of the ladle 10 for a purpose to be hereinafter described. Note that the liner has opposed pouring spouts 14 and 16 which correspond to the opposed pouring spouts shown on the external ladle. The ladle is generally fabricated of some high temperature steel so that it remains a solid even if directly exposed to the temperatures within a non-ferrous metal melt.

Figure 4:
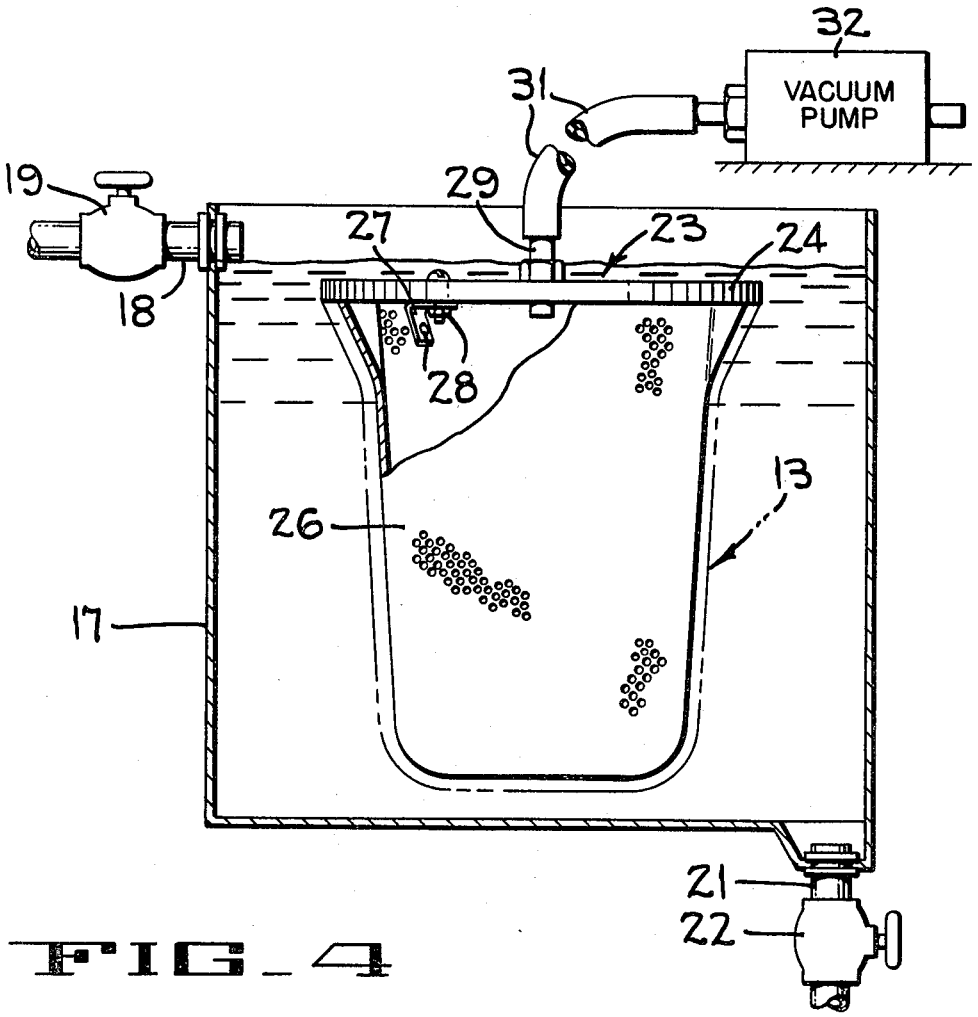
FIG. 4 is a side elevation and partial section of the liner forming apparatus according to the present invention.
Figure 5:
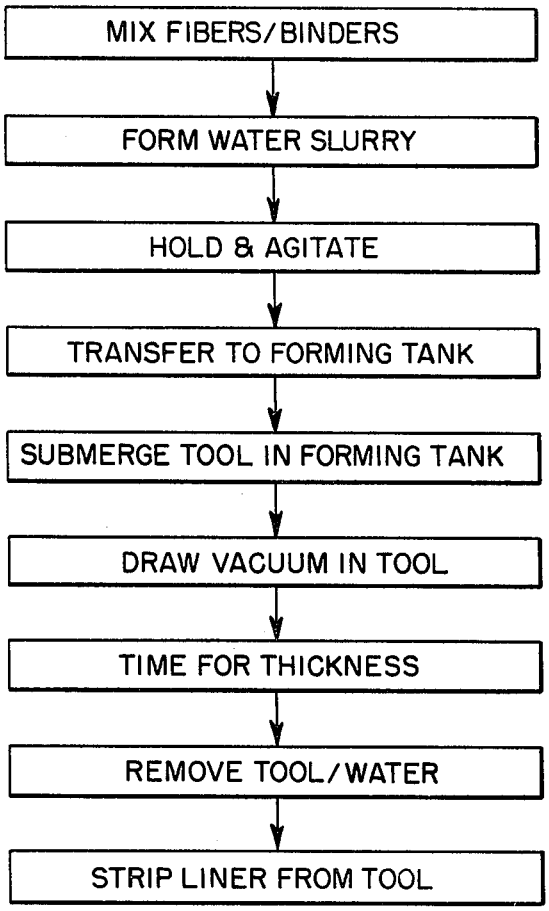
FIG. 5 is a diagram depicting the method of fabricating a ladle liner according to the present invention.

An apparatus and method for fabricating the ladle liner 13 are shown in FIGS. 4 and 5 of the drawings. FIG. 4 shows a forming tank 17 having a slurry inlet pipe 18 with a control valve 19 disposed therein and a slurry outlet pipe 21 with an outlet control valve 22 disposed therein. A liner forming tool is shown generally at 23 and includes a top plate 24 and a shaping portion 26 of the tool depending from the top plate. The shaping portion may be attached to the top plate by means of appropriate brackets 27 and fasteners 28, which may be rivets and/or bolts and nuts. The shaping portion 26 is fabricated of a screen material having openings therein of approximately 1/16th inch diameter. The shaping portion is held in abutting engagement with the underside of the top plate 24 and it appears no gasket is needed to effect a slurry seal between the top plate and the shaping portion. A centrally located hole is formed in the top plate through which a fitting 29 extends. The fitting is fixed in the top plate and has a passage therethrough. A flexible hose 31 is attached to the exterior end of the fitting 29 and leads to the input side of a vacuum pump 32.

With reference now to FIG. 5 which diagrammatically presents the process for fabricating a ladle liner 13, a mixture of fibers and binders is made, wherein the fibers may be aluminum silicate fibers and the binder may be some water soluble agent such as Ludox TM, manufactured by Milwaukee, Wis., wherein the fiber and binder is mixed in approximately ten to one ratio by weight. Water is added to the fiber and binder mixture to form a slurry having the consistency of a relatively thin pancake batter. The slurry is introduced to a holding tank (not shown) and agitated therein to provide thorough mixing of the ingredients. The slurry is thereafter transferred to the forming tank 17 through the pipe 18 with the valve 19 in an open position and the valve 22 in a closed position. With a sufficient amount of the slurry introduced into the forming tank 17 the forming tool 23 is introduced into the tank with the vacuum hose 31 coupling the interior of the forming tool to the vacuum pump 32. There is a sufficient amount of slurry in the holding tank 17 when the slurry extends to a level just above the top plate 24 on the forming tool when the tool is fully disposed within the tank. A vacuum is drawn within the inner chamber formed by the shaping portion 26 of the tool. The vacuum pump is exhausted to atmosphere thereby creating a pressure within the interior of the shaping portion 26 of the forming tool which is somewhat less than atmospheric pressure. The low pressure condition within the interior of the chamber in the forming tool is continued for a predetermined amount of time. This determines the thickness of a layer of fibers and binder which migrate to the outer surface of the shaping portion 26 of the tool. The layer of fibers and binder is shown as item 13 in phantom lines in FIG. 4. In practice the layer is approximately two inches thick. The forming tool is thereafter removed from the forming tank and the layer of fibers and binders which ultimately forms the liner 13 is dried. The drying process may include continuing the low pressure within the chamber in the tool followed by an air dry or an oven dry operation. Once the moisture is adequately removed from the shaped liner 13, the liner is stripped from the forming tool 23. The liner thereby takes the shape shown in FIG. 2 of the drawings. The resulting liner is burn resistant, is not readily wetted by molten non-ferrous metals and serves to insulate a melt contained therewithin from the carrying ladle 10 whereby heat loss from the melt is considerably reduced.

Figure 3:
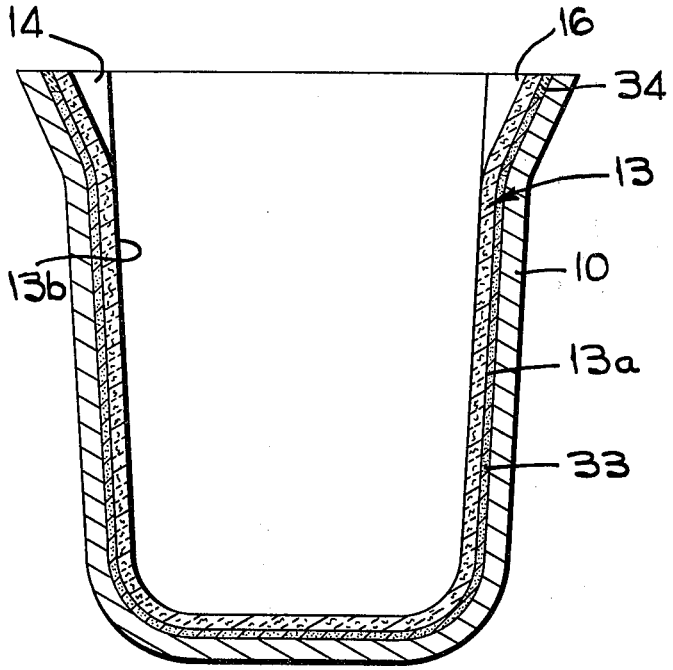
FIG. 3 is a vertical section of the ladle assembly of the present invention.

With reference now to FIG. 3 of the drawings a section is taken through a ladle assembly incorporating the disclosed invention wherein a steel ladle 10 has a burn resistant ladle liner 13 disposed therewithin. The exterior surface 13*a* of the liner is spaced from the internal contour of the ladle and a layer 33 of some particulate heat resistant material such as sand is disposed within the space therebetween. A refractory cap 34, about one to two inches thick is formed in a position overlying the upper edge of the sand layer 33 and extending across the gap between the upper edges of the ladle 10 and the liner 13. The refractory cap serves to both contain the sand within the layer 33 when the ladle assembly is tipped for pouring and to retain the ladle liner within the ladle and spaced from the interior surface thereof when the ladle is tilted or actually inverted to allow the melt to flow from one of the spouts 14 or 16. It is apparent that the exterior surface 13*a* of the ladle liner will only approximate the shape of the inner contour of the ladle 10. The sand layer 33 therefore functions to provide a fit and support for the liner at all points as it completely fills whatever gap exists between the inner contour of the ladle and the outer surface 13*a* of the liner. The sand layer may vary from about one quarter to an inch or so in thickness. A melt of considerable weight is thereby supported by all portions of the liner 13 and there is no danger of high local force loads causing the liner to rupture at any point.

Figure 6:
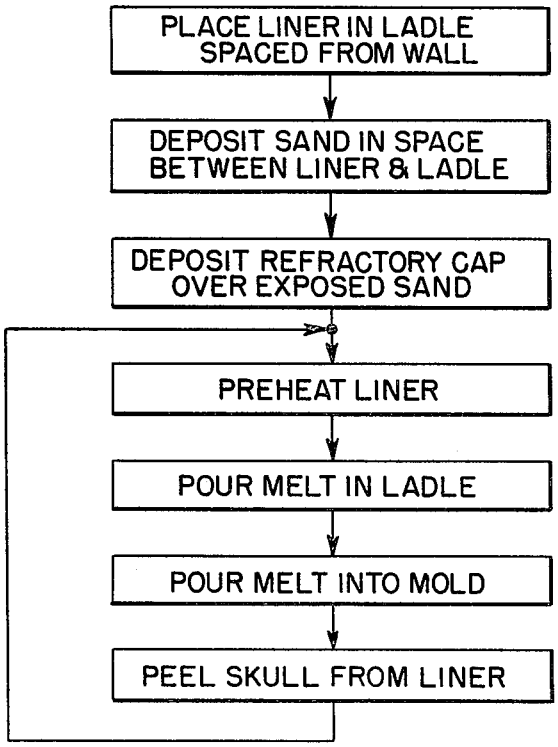
FIG. 6 is a diagram depicting the method of protecting a pouring ladle from the effects of transferring molten non-ferrous metals according to the present invention.

With reference now to FIG. 6 of the drawings the manner in which a ladle assembly as described in FIG. 3 is prepared and the manner in which it functions will now be described. A ladle liner 13 prepared as described in conjunction with FIGS. 4 and 5 and appearing as in FIG. 2 is placed within the ladle 10 such that the exterior surface 13*a* of the liner is spaced from the internal wall of the ladle. A layer 33 of sand is deposited throughout the space between the liner and the ladle. A refractory cap (zircon refractory, one to two inches thick, heat or air dried) is deposited around the upper edge of the sand layer 33 extending between the upper edges of the ladle and the liner. The liner is preheated merely to remove any residual moisture which may have been absorbed by the burn resistant fiber and binder materials comprising the liner. A "lazy" gas flame may be directed into the open end of the liner for a minute or two to accomplish this end. Alternatively, any type of low power heater, even including a bare energized 60 watt light bulb suspended within the interior of the liner, may be used to cause any liner surface moisture to migrate out of the ladle assembly. Following this relatively noncomplex preheating operation a portion of the melt from a heating furnace (not shown) is poured into the ladle assembly. The melt within the ladle assembly contacts only the inner surface 13*b* (FIG. 3) of the ladle liner 13. The melt portion is transported by the ladle assembly wherein the burn resistant liner is not substantially wetted by the melt and furthermore insulates the melt from the surrounding environment as mentioned hereinbefore. The melt is poured from the ladle assembly into a casting mold and the ladle assembly is ultimately emptied of the entire melt portion. After the ladle assembly has been emptied and has cooled somewhat, the dross formed when the melt is exposed to air as discussed hereinbefore, is left behind as a thin foil layer of skull on the surface 13*b* of the liner 13. It is a relatively simple and quickly performed task for a person to manually peel the foil-like skull from the inside surface of the liner. In this manner substantially all of the skull is removed from the ladle assembly prior to depositing a subsequent melt portion therein, whereby the aforementioned detrimental effects on the subsequent melt and castings poured therefrom are avoided.

It should be noted that up to seventy five heats or melt portions have been handled by a single ladle assembly containing a liner 13. The initial process includes all the steps set forth in FIG. 6 whereas each subsequent method performance is set forth in the steps extending from the preheat to the peeling stage described therein. The considerable advantages of both labor savings in merely having to peel the foil-like skull from the inside of the liner and in merely having to minimally preheat the liner to drive moisture therefrom are reflected in considerable cost savings. In this regard it has been noted hereinbefore that fifteen hundred cubic feet of gas per hour for an hour or more is required for the old art ladle assembly preheat as opposed to one or two minutes of low pressure gas expenditure or some other low power heater to remove moisture from the liner prior to pouring a melt into the ladle assembly of this invention. Further, the melt held in the ladle assembly of this invention wherein up to seventy five heats have been handled by a single assembly without replacement of the liner has been retained at temperatures up to 1400° F. within the ladle assembly for up to approximately one-half hour.

Although the best mode contemplated for carrying out the present invention has been herein shown and described, it will be apparent that modification and variation may be made without departing from what is regarded to be the subject matter of the invention.

What is claimed is:

1. A ladle assembly for receiving and transferring non-ferrous metal in a liquid state between a melting furnace and a mold, comprising a rigid external pouring ladle fabricated of a material having a melting point above the liquid metal temperature, a ladle liner of a material which burns at a temperature above the liquid metal temperature, said liner having an external surface generally similar in shape to and spaced from the internal surface of said external ladle, a particulate support mass disposed between said external and internal surfaces of said ladle liner and external ladle respectively, and a refractory cap overlying that portion of said particulate support mass which is exposed between the upper edges of said external ladle and said ladle liner.

2. A ladle assembly as in claim 1 wherein said ladle liner has a substantially uniform wall-thickness throughout.

3. A ladle assembly as in claim 1 wherein said particulate support mass comprises sand.

4. A ladle assembly as in claim 1 wherein said rigid external ladle comprises a steel ladle.

5. A ladle assembly for receiving and transferring non-ferrous metal in a liquid state between a melting furnace and a mold comprising a rigid external pouring ladle fabricated of a material having a melting point above the liquid metal temperature, a ladle liner of a material which burns at a temperature above the liquid metal temperature, said liner having an external surface generally similar in shape to the internal surface of said external ladle, and a refractory cap overlying that area along the upper edges of said external ladle and said ladle liner.

6. A method of fabricating a liner for a ladle adapted to hold molten non-ferrous metal, wherein a liner forming tool is used having an enclosed interior chamber and an exterior shape which is slightly smaller than but substantially similar to the shape of the ladle inner contour, comprising the steps of combining burn resistant fibers and a fiber binder in about ten to one proportions by weight with water, agitating the combination to form an aqueous slurry, transferring a portion of the slurry to a forming tank, submerging the liner forming tool in the slurry in the forming tank, reducing the pressure below atmospheric pressure within the enclosed interior chamber of the tool, timing the period during which the pressure is reduced, whereby a predetermined time corresponds to formation of a predetermined liner wall thickness, removing the tool with the formed liner adhering thereto from the forming tank, drying the liner adhering to the tool, and stripping the dried liner from the tool.

7. A method of preparing a pouring ladle to accept molten non-ferrous metal while protecting the ladle from adverse effects of the melt, comprising the steps of fabricating a burn resistant liner to fit within the interior of the ladle, placing the burn resistant liner within the ladle spaced from the ladle interior wall, depositing a granular mass within the space between the ladle wall and the liner, thereby supporting the liner within the ladle, and laying a refractory cap atop the upper boundary of the granular mass and extending between the upper edges of the ladle and the liner.

8. A method as in claim 7 together with the step of preheating the liner prior to pouring in the melt, whereby moisture is driven therefrom.

9. A method as in claim 8 wherein the step of preheating comprises playing a low pressure gas flame over the inside of the liner for 1 or 2 minutes.

10. A method as in claim 7, 8 or 9 wherein the melt is deposited in the prepared ladle from a melting furnace and transferred from the ladle by pouring into a mold, further comprising the step of peeling the skull deposited by the melt from the inside surface of the empty liner prior to pouring another portion of the melt therein.

11. A method of preparing a pouring ladle to accept molten non-ferrous metal while protecting the ladle from adverse effects of the melt, comprising the steps of fabricating a burn resistant liner to fit within the interior of the ladle, placing the burn resistant liner within the ladle adjacent to the ladle interior wall, and laying a refractory cap atop of and extending at least partly around the upper edges of the ladle and the liner.

12. A method as in claim 11 together with the step of preheating the liner for about one to two minutes prior to pouring in the melt, whereby moisture is driven therefrom.

13. A method as in claim 11 wherein the melt is deposited in the prepared ladle from a melting furnace and transferred from the ladle by pouring into a mold, further comprising the step of peeling the skull deposited by the melt from the inside surface of the empty liner prior to pouring another portion of the melt therein.

14. A method of protecting a molten metal pouring ladle from the effects of a non-ferrous melt which is being transferred from a melting furnace to a mold by the ladle, comprising the steps of placing a burn resistant liner within the ladle spaced from the ladle interior wall, depositing a layer of sand in the space between the liner and the ladle, thereby providing support for the liner, laying a refractory cap in position overlying the upper edge of the layer of sand and extending between the ladle and the liner, pouring a quantity of molten metal from the furnace into the lined ladle, emptying the molten metal from the lined ladle, and peeling the skull from the empty lined ladle prior to pouring a subsequent quantity of molten metal therein.

15. A method of protecting a molten metal pouring ladle from the effects of a non-ferrous melt which is being transferred from a melting furnace to a mold by the ladle, comprising the steps of shaping a burn resistant liner to have an outside surface substantially conforming to the inside surface of the pouring ladle, placing the burn resistant liner within the ladle adjacent to the ladle interior wall, laying a refractory cap in position overlying the upper edges of and extending at least part way around the ladle and the liner, pouring a quantity of molten metal from the furnace into the lined ladle, emptying the molten metal from the lined ladle, and peeling substantially all of the skull from the empty lined ladle prior to pouring a subsequent quantity of molten metal therein.

* * * * *